US008341785B2

(12) United States Patent
Fiebrich et al.

(10) Patent No.: US 8,341,785 B2
(45) **Date of Patent: *Jan. 1, 2013**

(54) INDIVIDUAL CRIB RAIL BUMPER

(75) Inventors: Georgia G. Fiebrich, San Antonio, TX (US); Catherine N. Hall, Castlerock, CO (US)

(73) Assignee: Go Mama Go Designs LLC, San Antonio, TX (US)

( * ) Notice: Subject to any disclaimer, the term of this patent is extended or adjusted under 35 U.S.C. 154(b) by 450 days.

This patent is subject to a terminal disclaimer.

(21) Appl. No.: 12/765,201

(22) Filed: Apr. 22, 2010

(65) Prior Publication Data

US 2011/0041253 A1 Feb. 24, 2011

Related U.S. Application Data

(63) Continuation-in-part of application No. 12/052,974, filed on Mar. 21, 2008, now Pat. No. 7,895,691.

(51) Int. Cl.

| | |
|---|---|
| ***A47D 15/00*** | (2006.01) |
| ***A47D 7/00*** | (2006.01) |
| ***A47D 13/06*** | (2006.01) |
| ***A47C 21/08*** | (2006.01) |

(52) U.S. Cl. ..... 5/663; 5/946; 5/424; 5/93.1

(58) Field of Classification Search ..... 5/663, 658, 5/93.1, 100, 424, 425, 946

See application file for complete search history.

(56) References Cited

U.S. PATENT DOCUMENTS

| | | | | |
|---|---|---|---|---|
| 2,203,921 | A * | 6/1940 | Padjen | 5/100 |
| 2,600,556 | A | 6/1952 | Malm | |
| 3,018,492 | A * | 1/1962 | Rosen | 5/93.1 |
| 3,241,158 | A * | 3/1966 | Berl | 5/93.1 |
| 3,430,272 | A | 3/1969 | Thorn | |
| 3,803,646 | A | 4/1974 | Newerowski | |
| 3,877,090 | A | 4/1975 | Schutz | |
| 3,956,783 | A * | 5/1976 | Stoller | 5/737 |
| 4,670,923 | A | 6/1987 | Gabriel et al. | |
| 4,767,419 | A | 8/1988 | Fattore | |
| 4,800,600 | A | 1/1989 | Baum | |
| 4,890,346 | A | 1/1990 | Rist | |
| 5,010,611 | A | 4/1991 | Mallett | |
| 5,048,892 | A | 9/1991 | Ledbetter | |
| 5,241,718 | A | 9/1993 | Pope | |
| 5,410,765 | A * | 5/1995 | Youngblood | 5/93.1 |
| 5,421,046 | A | 6/1995 | Vande Streek | |
| 5,437,071 | A * | 8/1995 | Feigenbaum | 5/663 |

(Continued)

OTHER PUBLICATIONS

Gershman, Maurice M.D. "Selft-Adhering Nylon Tapes." Journal of A.M.A. (vol. 168, No. 7) Oct. 18, 1958.*

*Primary Examiner* — Robert G Santos

(74) *Attorney, Agent, or Firm* — The Marbury Law Group, PLLC

(57) ABSTRACT

A crib rail bumper is formed with a cushioning pad, a fabric cover dimensioned to encompass the pad, and reversible fastening means on opposite sides of the cover for securing the cover and pad to the crib rail. The reversible fastening means is preferably a reversible zipper. The crib rail bumper is compressible along the length dimension so as to encompass crib rails of varying lengths. The cushioning pad has a major length dimension, a minor width dimension, and a thickness dimension, the dimensions being selected for encompassing a crib rail. The reversible fastener allows multiple bumpers to be attached together to encompass wide rails or a plurality of rails.

22 Claims, 9 Drawing Sheets

U.S. PATENT DOCUMENTS 5,542,135 A * 8/1996 Ozrovitz et al. ..... 5/424
5,706,534 A 1/1998 Sherman
5,926,873 A 7/1999 Fountain
5,937,458 A 8/1999 DeRosa
5,960,493 A 10/1999 Rhey et al.
6,055,690 A 5/2000 Koenig
6,301,731 B1 10/2001 Jakubowski et al.
6,401,281 B1 6/2002 Younge
6,438,775 B1 8/2002 Koenig
6,564,403 B1 5/2003 Titus
6,574,812 B2 * 6/2003 Jakubowski et al. ..... 5/658
6,604,789 B1 8/2003 Downing
6,684,437 B2 2/2004 Koenig
6,742,751 B1 * 6/2004 DeMoor ..... 248/345.1
6,772,457 B1 8/2004 Alaback
6,957,464 B1 10/2005 Coauette
7,055,192 B2 6/2006 Waters et al.
D539,587 S 4/2007 Bonal
7,213,282 B1 5/2007 Wojtowicz
7,895,691 B2 * 3/2011 Fiebrich ..... 5/663
2002/0035753 A1 * 3/2002 Jakubowski et al. ..... 5/658
2002/0178500 A1 12/2002 Koenig
2007/0257049 A1 11/2007 Tolan
2009/0211023 A1 * 8/2009 Cocco et al. ..... 5/424
2009/0235453 A1 * 9/2009 Fiebrich ..... 5/424
2011/0041253 A1 * 2/2011 Fiebrich et al. ..... 5/663

* cited by examiner

INDIVIDUAL CRIB RAIL BUMPER

RELATED APPLICATIONS

This application is a Continuation-In-Part of application Ser. No. 12/052,974, filed Mar. 21, 2008, now U.S. Pat. No. 7,895,691.

BACKGROUND

Embodiments disclosed herein relate to the field of crib bumpers and the use of protective padding in or around a child's crib to increase bodily protection as well as provide additional comfort and support. Disclosed embodiments provide a reversible pad secured individually or in multiples to a single crib rail, or in multiples to a plurality of rails, through use of a reversible fastener such as a zipper. The reversible pads are long enough to accommodate most crib rails and are compressible for use with shorter or lowered rails.

DETAILED DESCRIPTION OF THE INVENTION

Figure 1:
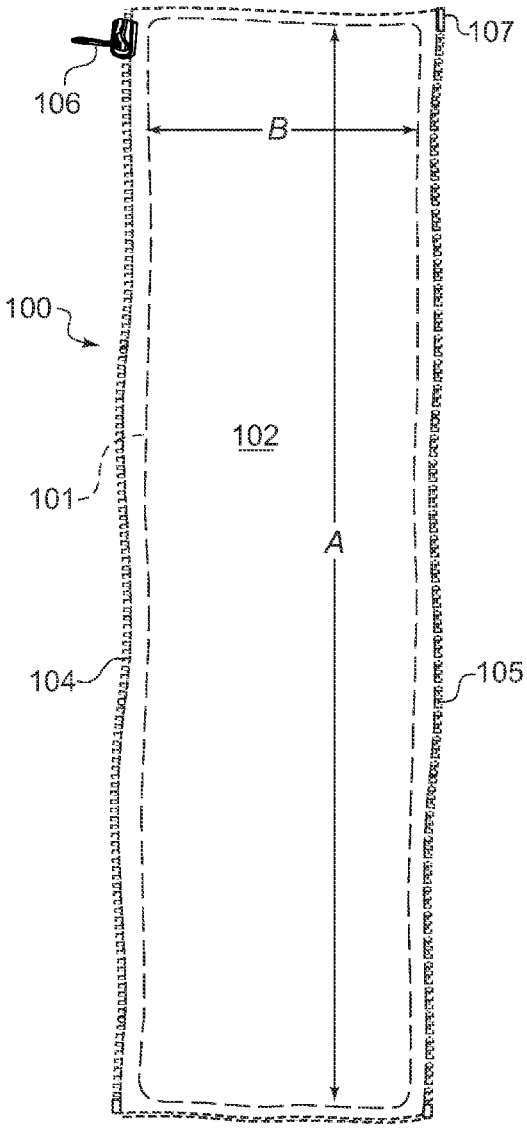
FIG. 1 is a graphical projection illustrating a first side of an embodiment of a crib rail bumper.

FIG. 1 illustrates a first embodiment of a crib rail bumper 100 that includes a cushioning pad 101 (shown in phantom) that is enclosed in a fabric cover having a first side 102. The pad 101 has a major length dimension A, a minor width dimension B, and a thickness dimension (not illustrated), wherein the dimensions are selected for encompassing a large variety of crib rails. In a preferred embodiment, the pad is approximately 24" (~61 cm) long, approximately 6" (~15 cm) wide, and has a thickness between approximately ¼" to ⅜" (~6 mm-10 mm) depending on the material chosen. Any suitable material may be used for the pad 101, including but not limited to open cell polyurethane foam with a thickness of ~⅜" and a closed cell polyethylene foam with a thickness of ~¼". In certain embodiments, a Teflon® (polytetrafluoroethylene or PTFE) or similar cover or lining can be used with the pad to ease insertion or removal from the fabric cover.

Embodiments using open cell foam are sufficiently compressible to allow easy use with shorter crib rails. However, such open cell foam embodiments are more difficult to clean. Additionally, if a child is breathing adjacent to such open cell embodiment bumpers, the bumpers may allow some undesirable re-breathing of CO2. Embodiments using closed cell foam are more easily cleaned, thus being less susceptible to mold or mildew. Moreover, such closed cell foam embodiments do not allow re-breathing of CO2. However, such closed cell foam embodiments may not compress as well or as evenly as typical open cell foam embodiment bumpers.

In further embodiments, the cover or lining for the pad can be made of a polypropylene non-woven material, which has inherent water repellant properties and offer similar SIDS-reducing advantages of closed-cell foam while allowing the flexibility of open-cell foam. The polypropylene non-woven material can protect and extend the useful life of the foam padding while retaining washability. In an organic, eco-friendly embodiment, the foam pad can be made from 100% natural latex foam. In a preferred embodiment, a closed-celled latex foam ~⅜" (~10 mm) thick can be used. In an alternate embodiment, perforated open-cell foam can also be used for improved breathability.

Figure 2:
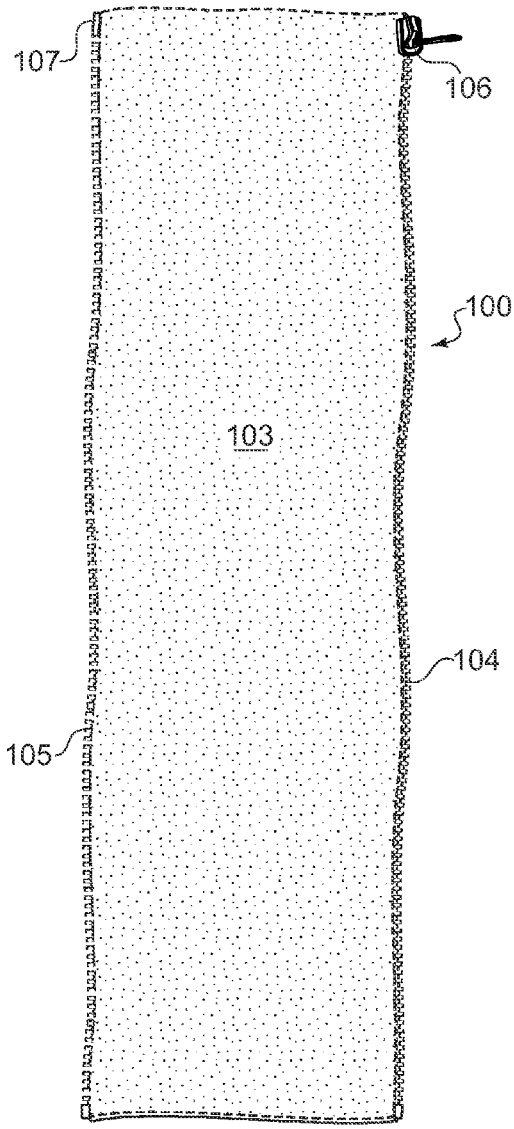
FIG. 2 is a graphical projection illustrating a second side of an embodiment of a crib rail bumper.

FIG. 2 illustrates a second side of the first embodiment of the crib rail bumper of FIG. 1. The second side 103 of the fabric cover is sewn or otherwise joined together with the first side 102 to enclose the pad 101. Reversible fastening means are attached on opposite sides of the cover for securing the bumper 100 to the crib rail. In a preferred embodiment, a reversible zipper is used, wherein complimentary zipper elements 104 and 105 are attached to each other by inserting zipper pin 107 into slider 106 and pulling the slider 106. Other reversible fasteners may include buttons, snaps, Velcro, ties, etc. In a preferred embodiment, different fabrics or colors can be used for sides 102 and 103 so that the aesthetics of the crib rail bumper can be altered by reversing which side is facing out. Suitable fabrics should preferably be soft to the touch and easy to clean, and can use natural fibers, synthetic fibers and blends thereof. The smaller physical size of the individual bumpers 100 in comparison to prior art designs allows easier handling, installation, removal, and washing.

Figure 3:
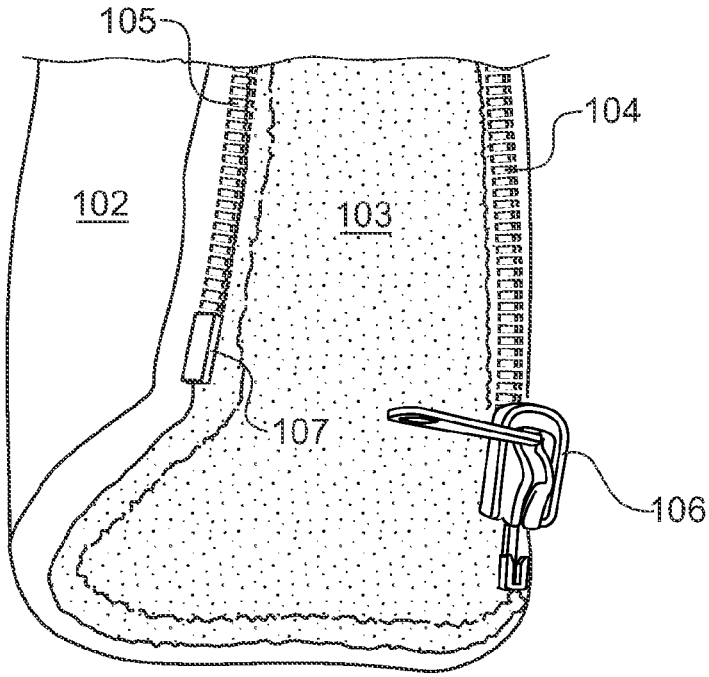
FIG. 3 is a graphical projection illustrating a close-up view of one end of an embodiment of a crib rail bumper.
Figure 4:
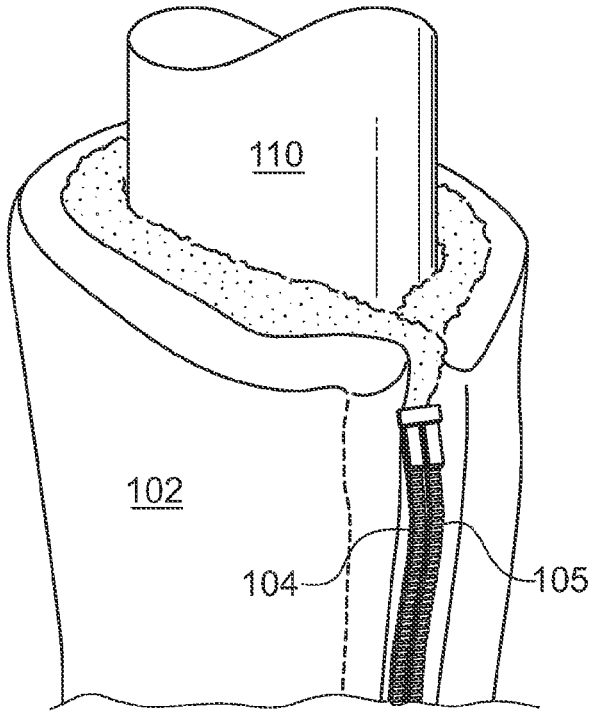
FIG. 4 is a graphical projection illustrating a close-up view of another end of an embodiment of a crib rail bumper in place on a crib rail.

FIGS. 3 and 4 illustrate close-up views of one end of an embodiment of a crib rail bumper. To attach the bumper to a rail 110, pin 107 on zipper element 105 is inserted into slider 106 of zipper element 104 so that when slider 106 is pulled, the zipper elements 104, 105 are joined to secure the bumper to rail 110. As illustrated in FIG. 3, a first side 102 is facing outward, but the reversible nature of elements 104, 105 and slider 106 also allow attachment with second side 103 facing outward.

Figure 5A:
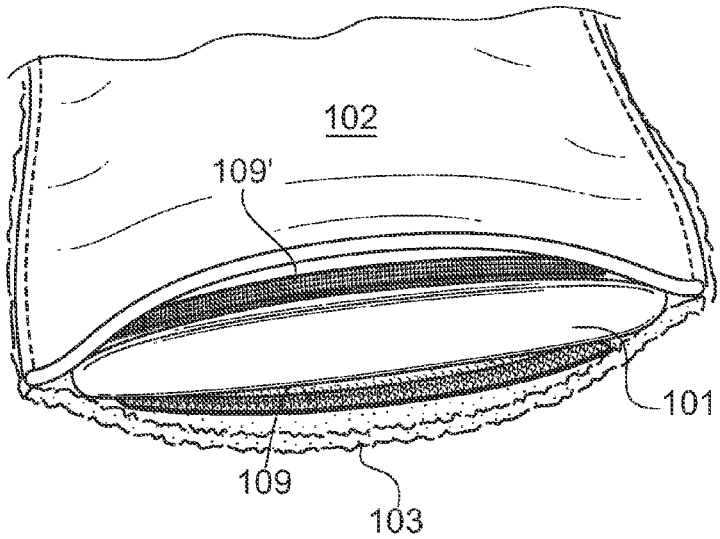
FIG. 5A is a graphical projection illustrating a close-up view of an open access opening for a pad of an embodiment of a crib rail bumper.
Figure 5B:
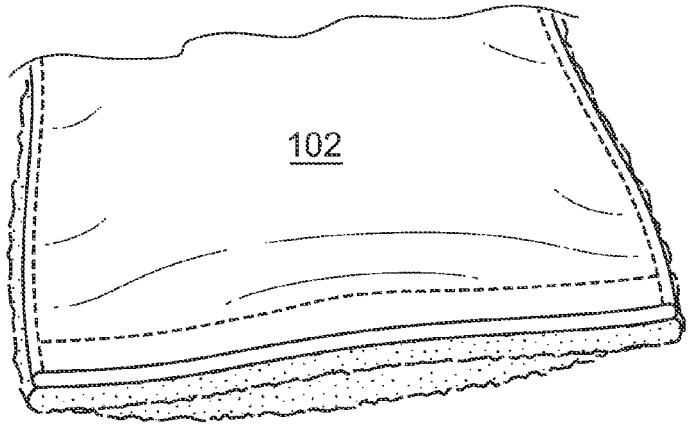
FIG. 5B is a graphical projection illustrating a close-up view of an closed access opening for a pad of an embodiment of a crib rail bumper.

In practice, the pad 101 can be sewn into the cover formed by sides 102 and 103. Optionally, the cover can be formed as a re-sealable pocket in which pad 101 can be inserted or removed by use of a re-sealable access opening. FIG. 5A illustrates a close-up view of an open access opening for a pad 101 of an embodiment of a crib rail bumper. An inside end of first side 102 has a re-sealable fastening means 109 such as one side (e.g., a loop side) of a hook and look fastener (e.g., Velcro® brand fastener) and the facing inside end of second side 103 has a mating fastening means 109' such as the other (e.g., a hook side) of the hook and look fastener. After pad 101 is inserted into the access opening, the fastening means is closed to keep the pad in place, as illustrated in FIG. 5B. Such a design allows the pad 101 to be removed for cleaning or replacement and allows the cover portion to be more easily machine-washed.

Figure 5C:
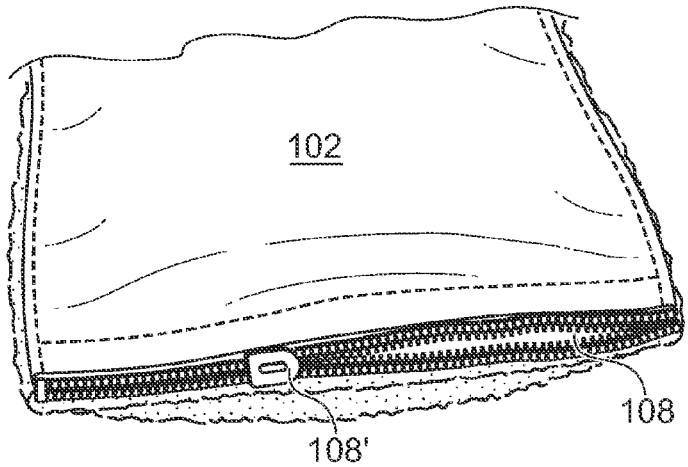
FIG. 5C is a graphical projection illustrating an alternative access opening for a pad that uses a zipper without a pull.

FIG. 5C illustrates an alternative embodiment wherein the access opening is fastened by a zipper 108 instead of a hook and loop fastener. In a preferred form, the zipper 108 is made of plastic and uses a plastic slider 108' that has no pull so as to minimize the presence of hard materials in the bumper construction. Such an embodiment allows the foam pad to more closely match the length of the fabric cover, eliminates misalignments that can occur with hook and loop fasteners, and improves the overall aesthetics of the crib bumper. The access opening allows a user to remove, replace, or reshape the lined foam pad, such as for washing or replacement of the pad or washing or replacement of the fabric cover.

Figure 6:
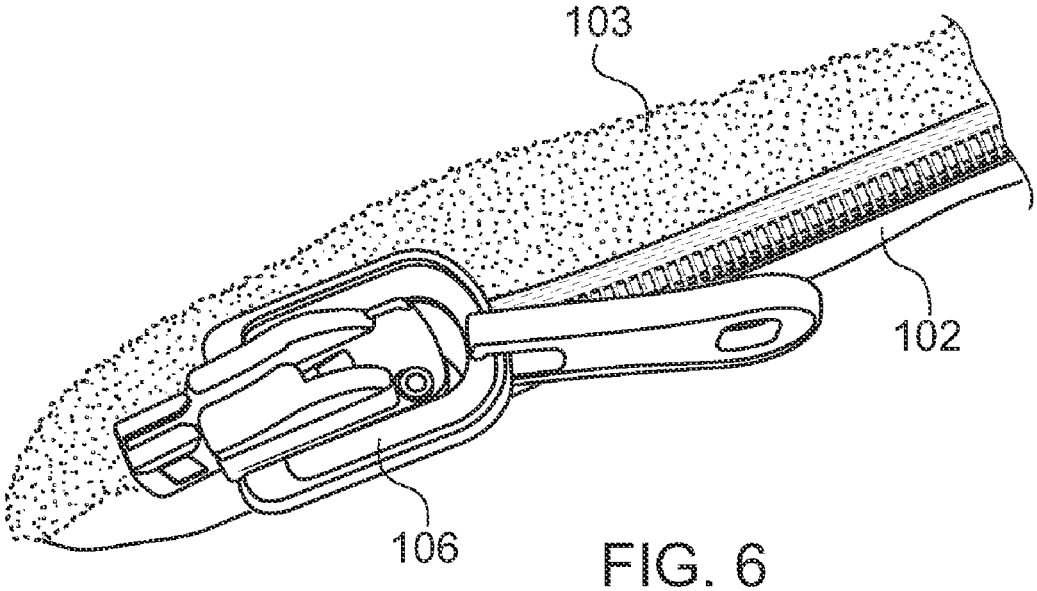
FIG. 6 is a graphical projection illustrating a close-up view of a reversible zipper latch of an embodiment of a crib rail bumper.
Figure 7:
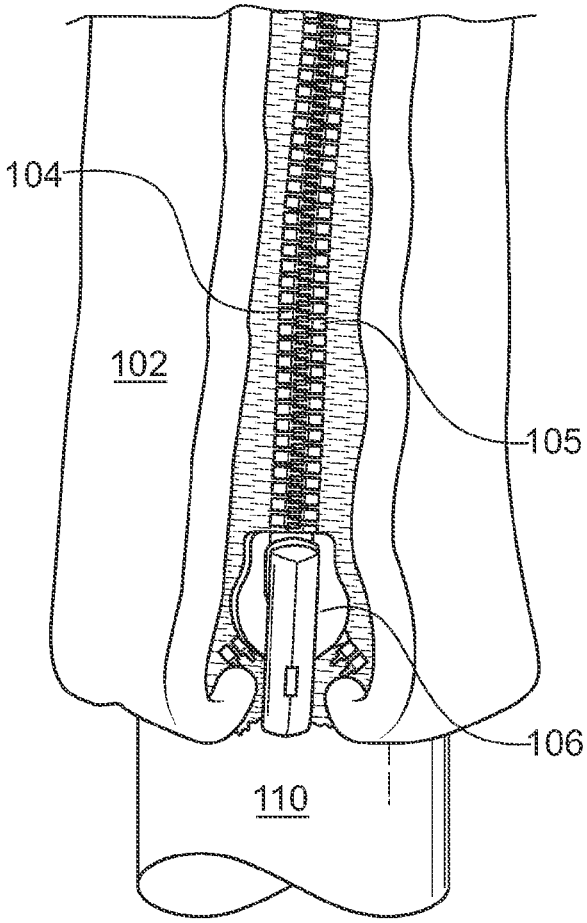
FIG. 7 is a graphical projection illustrating a close-up view of a zipper latch when installed on a rail in an embodiment of a crib rail bumper.

FIG. 6 illustrates a close-up view of a reversible zipper slider 106 of an embodiment of a crib rail bumper. As shown, the slider 106 has a pull that can slide along a U-shaped member so that it can be used from both sides of the bumper. As illustrated in FIG. 7, which shows a close-up view of a zipper slider 106 when installed on a rail 110 in an embodiment of a crib rail bumper, the pull (not shown) of slider 106 can be moved or tucked in to the reverse side of the bumper after installation so that it will not be accessible to a child in the crib. In such a manner, the attachment means for the bumper is inaccessible to a child so that the child cannot remove the bumper.

If such a reversible zipper is selected as the reversible fastener, any suitable lead-free zipper can be used, although plastic zipper elements are preferred due to better washability and coiled plastic elements are preferred so as to avoid hard or sharp edges that might possibly scratch or injure a child. It is further possible to have enough excess material at the edges of sides 102, 103 to extend to or beyond the zipper tape so the excess material overlaps and covers the zipper. Other suitable reversible fasteners include zip-lock style plastic fasteners.

Figure 8:
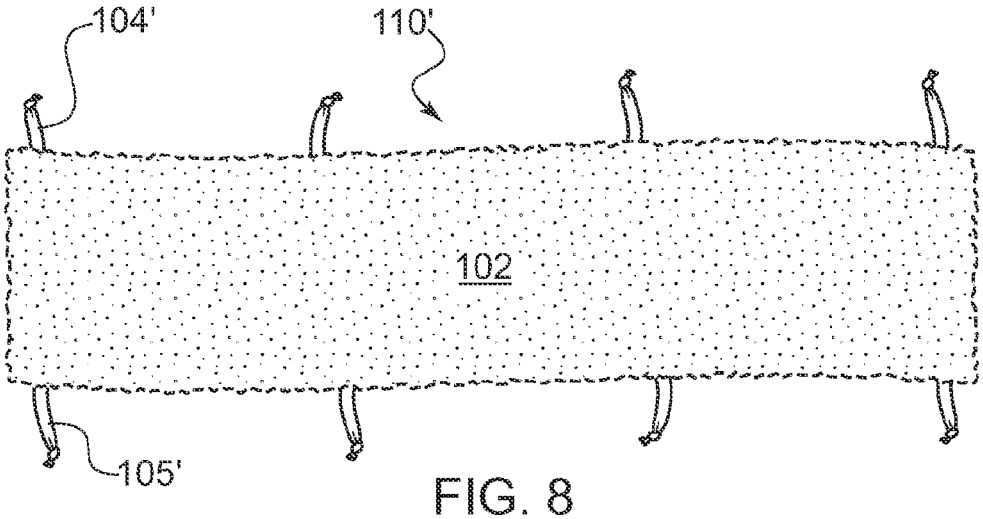
FIG. 8 is a graphical projection illustrating an alternate embodiment of a crib rail bumper suitable for top rails.

FIG. 8 illustrates an alternate embodiment of a crib rail bumper 100' suitable for top rails to provide cushioning and prevent damage from teething on the top rail. The bumper 100' includes a pad (not illustrated) and, preferably, is similarly sized and uses fasteners such as ties 104' and 105' to secure to a top rail of a crib. Plural bumpers 100' can be used adjacent each other and compressed so as to fit the length of the top rail. As with the other disclosed bumpers, the first side 102 can be made from the same or a different fabric than the second side (not illustrated). The ends of ties 104', 105' can be knotted so as to prevent fraying and the ties are preferably formed from strips of sufficiently strong fabric. The length of the ties are kept sufficiently short so as to avoid a potential strangulation hazard. In alternative embodiments other types of fasteners may be used in place of ties 104' and 105'. For example, buttons, snaps, and Velcro, or combination thereof, may be used to fasten the top rail bumper to the top rail. Each of the alternative fasteners may be configured so that fastening occurs between vertical rails of the crib.

Figure 9:
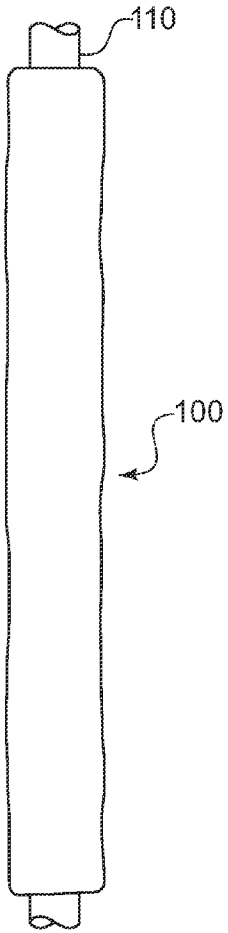
FIG. 9 is a graphical projection illustrating an embodiment of a crib rail bumper installed on a single rail.

FIG. 9 illustrates an embodiment of a crib rail bumper 100 installed on a single longer rail 110. In an uncompressed state, the bumper preferably covers substantially the entire length of the rail 110, although small portions at the ends do not necessarily need to be covered since the padding will generally protect against contact with portions directly adjacent thereto. When used in this manner, the crib rail bumper 100 provides more protection from impact than prior art designs that typically only protect against impact with the lower portion of the crib rail 110. When the bumper 100 is dimensioned to conform closely to the rail 110, the bumper 100 can be secured to or grip the rail 110 in such a manner that it cannot be used as a step to assist a small child in climbing out of the crib, like some prior art designs.

Figure 10B:
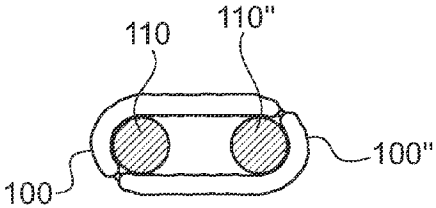
FIG. 10B is a cross-sectional view of an embodiment of a pair of crib rail bumpers installed on a pair of crib rails.
Figure 10A:
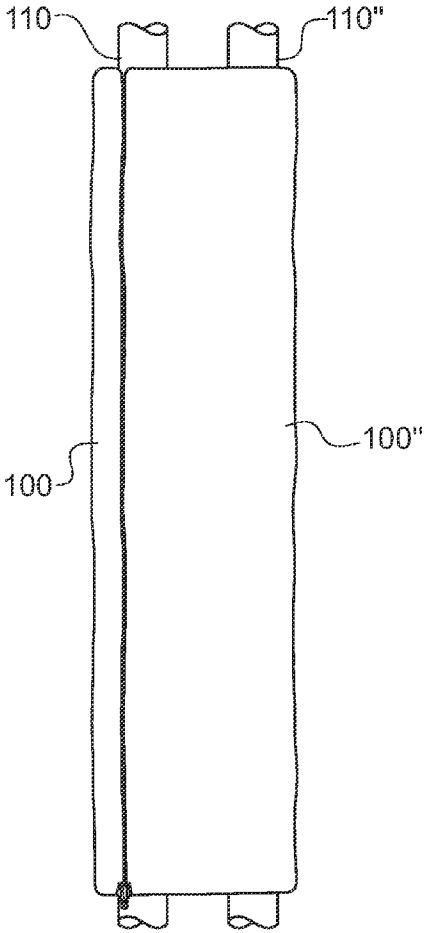
FIG. 10A is a graphical projection illustrating a side view of an embodiment of a pair of crib rail bumpers installed on a pair of crib rails.

FIGS. 10A and 10B illustrate a planar and cross sectional view of an embodiment of a pair of crib rail bumpers 100, 100" installed on a pair of crib rails 110, 110". In such an arrangement, a first edge of bumper 100 is joined by the cooperating zipper elements to a second edge of bumper 100" and a first edge of bumper 100" is zippered to the second edge of bumper 100. Such an arrangement can be used when the rails have unusually large diameters (such that a single bumper does not fit well), at corners, when the crib includes hardware adjacent a rail that needs to be covered, or for aesthetic reasons.

Although illustrated with a joined pair of identical crib rail bumpers 100, 100", this is not meant to be a limitation. With the ever-expanding variety of crib rails on the market and the trend toward wider crib rails, the ability to join multiple crib rail bumpers through use of a reversible fastener such as reversible zippers allows the disclosed bumpers to be adapted to new situations. Crib rail bumpers having fractional widths (such as ~2" or ~5 cm, ~3" or ~7-8 cm) could also be joined with one or more additional full width crib rail bumpers so as to allow use on a wide variety of individual crib rails or groups of crib rails. In certain situations, it may also be desirable to produce crib rail bumpers of different lengths or widths to accommodate cribs rails that vary significantly from the typical crib, such as those produced by Stokke.

Figure 11:
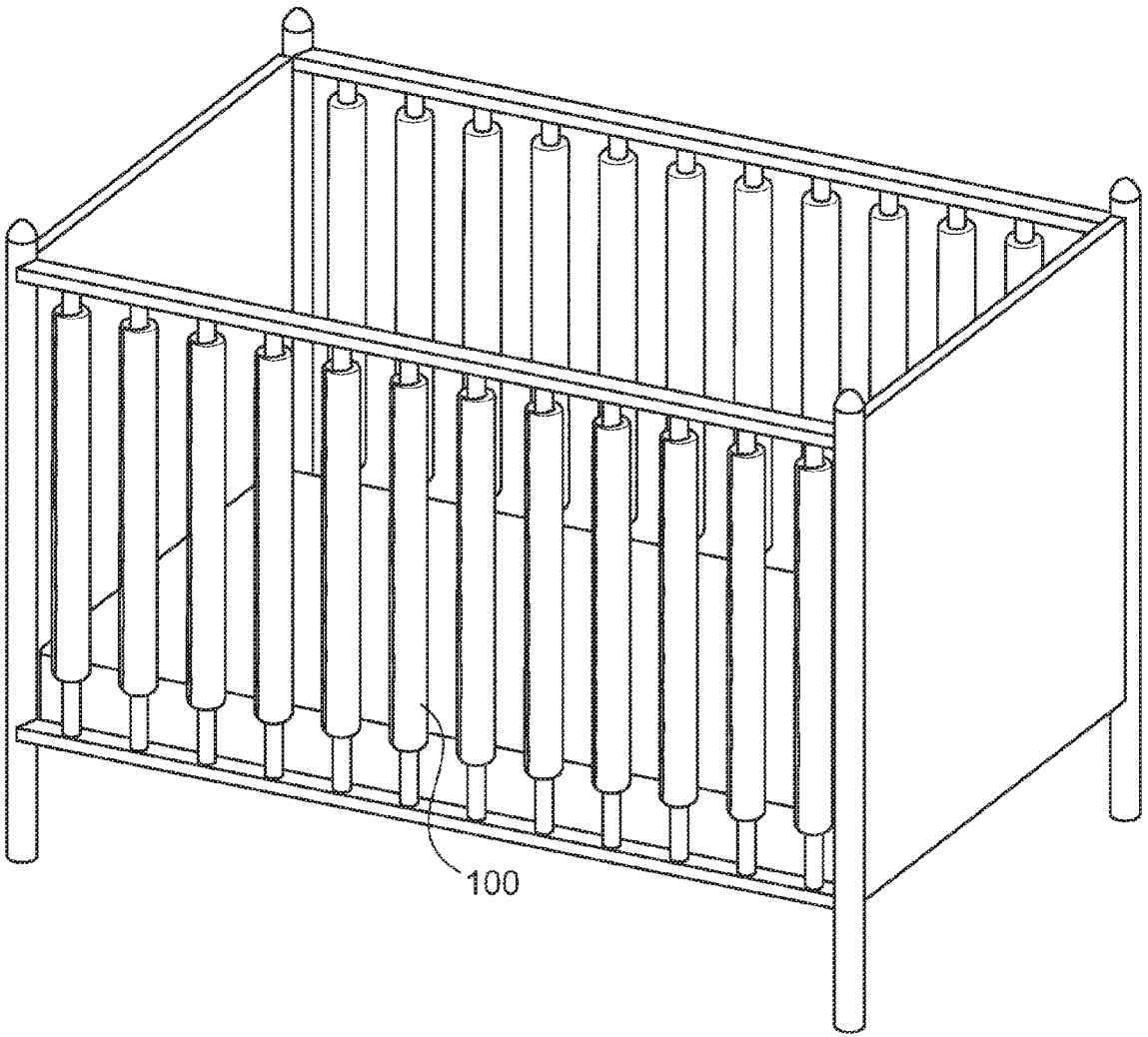
FIG. 11 is a graphical projection illustrating an embodiment set of crib rail bumpers installed on long crib rails.
Figure 12:
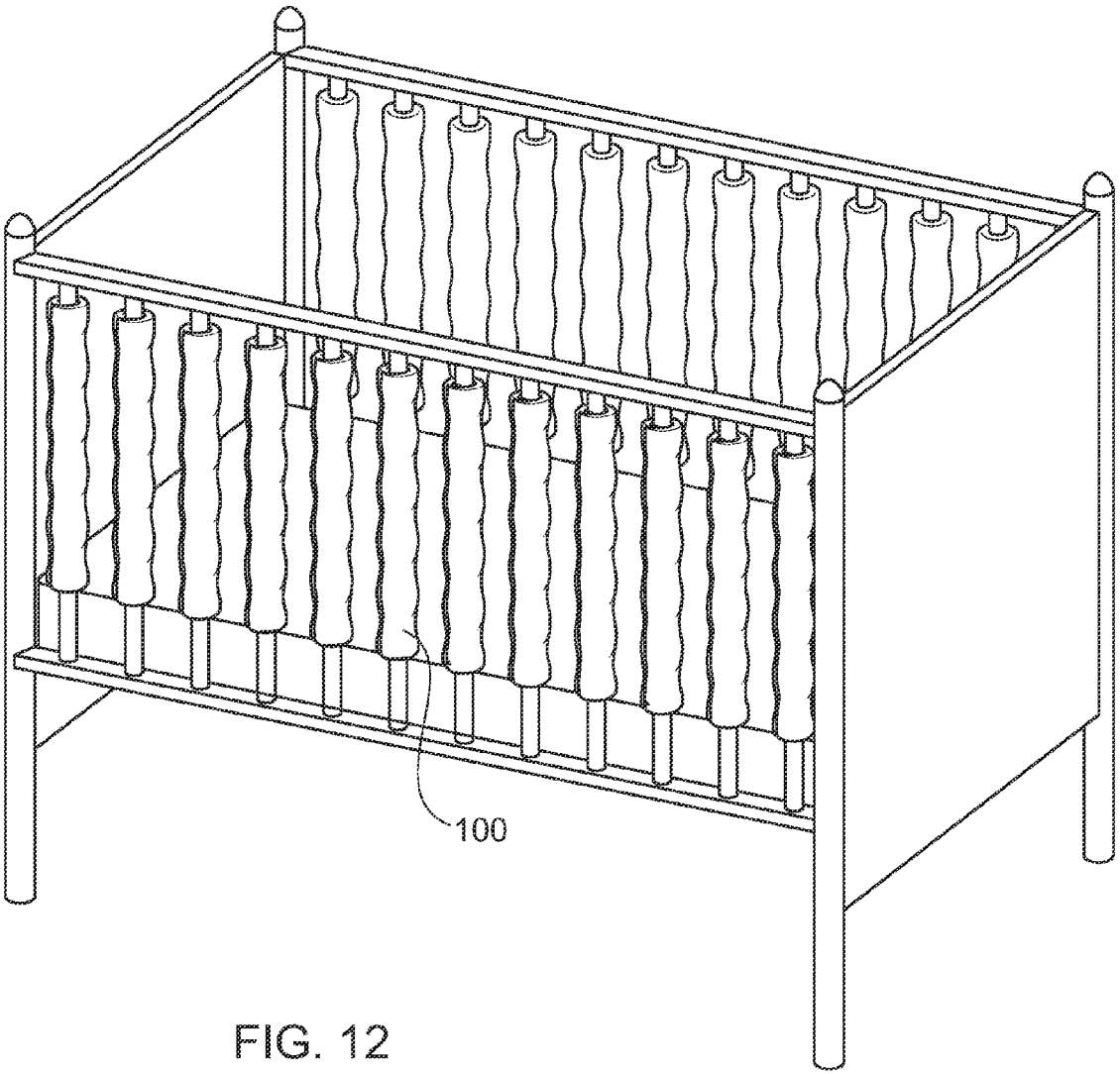
FIG. 12 is a graphical projection illustrating an embodiment of a set of compressed crib rail bumpers installed on shorter crib rails.
Figure 13:
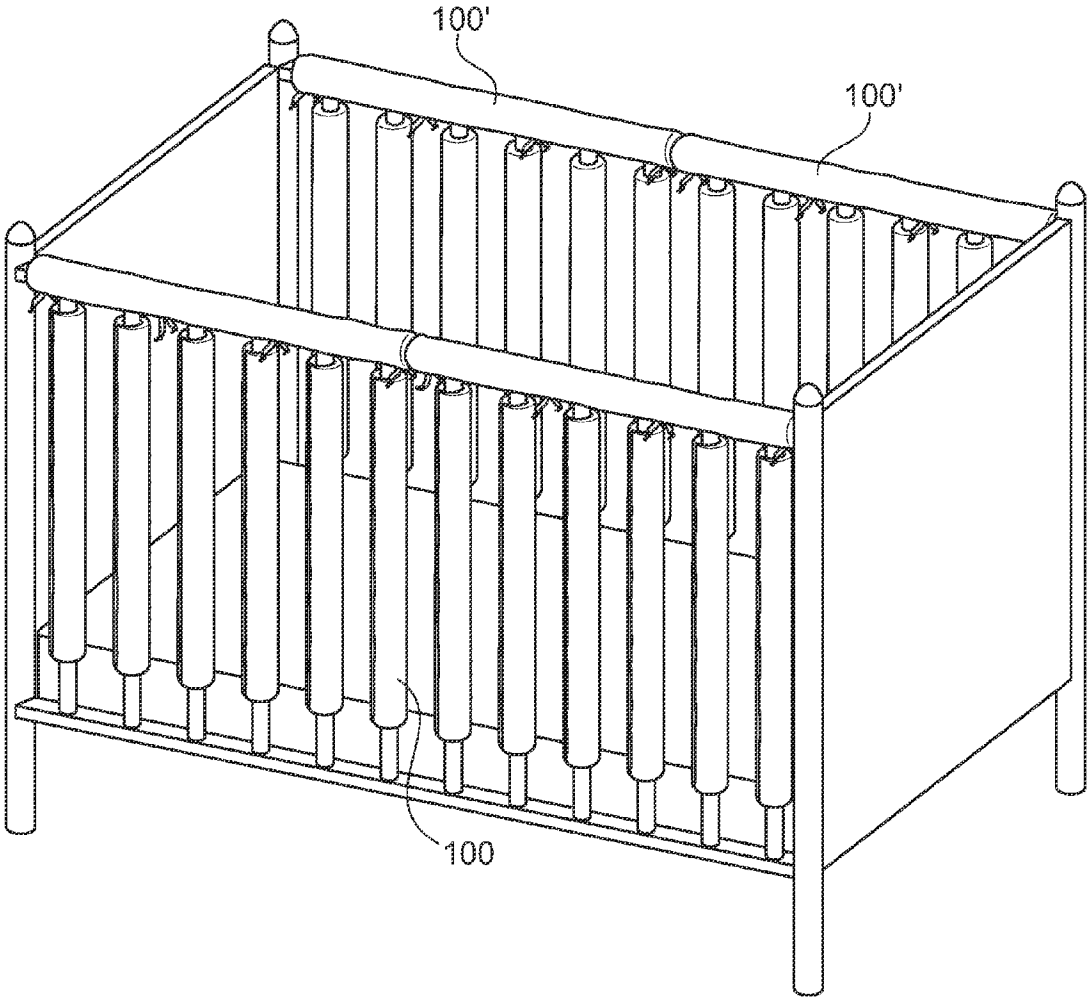
FIG. 13 is a graphical projection illustrating an embodiment of a set of crib rail bumpers with top rail bumpers installed on a crib.

FIG. 11 illustrates an embodiment of a set of crib rail bumpers 100 installed on long crib rails. FIG. 12 illustrates an embodiment of a set of compressed crib rail bumpers 100 installed on shorter crib rails. FIG. 13 illustrates an embodiment of a set of crib rail bumpers 100 with top rail bumpers 100' installed on a crib. As illustrated in the FIGS. 11-13, bumpers 100 allow air to freely flow to all portions of the crib through the open, adjacent rails so as to minimize Sudden Infant Syndrome (SIDS) due to disrupted air circulation. The open design also allows newborns to see out of the crib and parents to see the newborn in the crib. The open design further prevents accidental smothering of a child, which can be an issue with prior art designs. Additionally, by attaching to individual crib rails, the bumpers of the present design does not need to be removed to access the other bedding. The bumpers stay in place and do not interfere with crib operation, such as when the side of a crib is lowered for access to the crib.

By using materials such as foam padding, fabric and zippers, as well as a structure lacking rigid support elements, the disclosed embodiments allow the bumpers 100 to compress to fit the rail. In such a manner, a single size bumper 100 can be used with rails of various lengths to provide a "one size fits all" solution for a majority of crib owners. A plurality of uniform-sized bumpers 100 (and/or 100') can be sold as a set for use with a large variety of cribs.

A basic embodiment of a crib rail bumper comprises a cushioning pad having a major length dimension, a minor width dimension, and a thickness dimension, the dimensions being selected for encompassing a crib rail; a fabric cover dimensioned to encompass the pad; and reversible fastening means on opposite sides of the cover for securing the cover and pad to the crib rail, wherein the crib rail bumper is compressible along the length dimension so as to encompass crib rails of varying lengths.

Optional variations on this embodiment include those wherein: the reversible fastening means is a reversible zipper; the reversible fastening means comprises a plurality of string ties; the major length dimension is approximately 24 inches (~61 cm) and the minor width dimension is approximately 6 inches (~15 cm); the thickness dimension is between approximately ¼ inch and ⅜ inch (~6 mm-10 mm); the cushioning pad and cover are compressible along the length dimension so as to encompass crib rails of between approximately 6-26 inches (~15-66 cm); and the fabric cover comprises a first side formed of a first fabric and a second side formed of a second fabric.

In another variation of the basic embodiment, the fabric cover further comprises a resealable opening to allow insertion and removal of the cushioning pad, with the resealable opening preferably comprising a hook and loop closure.

The cushioning pad can comprise a closed-cell polyethylene foam, preferably with a thickness of ~¼ inch (~6.35 mm). The cushioning pad can also comprise an open-cell polyurethane foam, preferably with a thickness of ~⅜ inch (~9.5 mm). In preferred embodiments, the cushioning pad has a substantially uniform thickness.

In embodiments comprising a reversible zipper, the opposite sides of the zipper can connectable to corresponding zipper portions of another crib rail bumper so as to encompass a wide rail or a plurality of adjacent crib rails.

Another embodiment is to a set of crib rail bumpers comprising a plurality of crib rail bumpers in accordance with the basic embodiment, wherein each crib rail bumper is substantially identical in size. In a variation of this embodiment, the major length dimension of each cushioned pad is approximately 24 inches (~61 cm) and the minor width dimension of each cushioned pad is approximately 6 inches (~15 cm). In another variation of this embodiment, each cushioning pad and cover are compressible along the length dimension so as to encompass crib rails of between approximately 6-26 inches (~15-66 cm). Optionally, each fabric cover comprises a first side formed of a first fabric and a second side formed of a second fabric, wherein the first fabric and the second fabric preferably comprise aesthetically complimentary colors or patterns.

A system and method for providing individual crib rail bumpers has been described. It will be understood by those skilled in the art that the present invention may be embodied in other specific forms without departing from the scope of the invention disclosed and that the examples and embodiments described herein are in all respects illustrative and not restrictive. Those skilled in the art of the present invention will recognize that other embodiments using the concepts described herein are also possible. Further, any reference to claim elements in the singular, for example, using the articles "a," "an," or "the" is not to be construed as limiting the element to the singular.

What is claimed is:

1. A crib rail bumper, comprising:

a cushioning pad having a major length dimension, a minor width dimension, and a substantially uniform thickness dimension, the dimensions being selected for encompassing a crib rail;

a fabric cover dimensioned to encompass the pad; and reversible fastening means on opposite sides of the cover for securing the cover and pad to the crib rail, wherein the crib rail bumper is compressible along the length dimension so as to encompass crib rails of varying lengths.

2. The crib rail bumper of claim 1, wherein the reversible fastening means is a reversible zipper.

3. The crib rail bumper of claim 1, wherein the reversible fastening means comprises a plurality of string ties.

4. The crib rail bumper of claim 1, wherein the major length dimension is approximately 24 inches (~61 cm) and the minor width dimension is approximately 6 inches (~15 cm).

5. The crib rail bumper of claim 4, wherein the thickness dimension is between approximately ¼ inch and ⅜ inch (~6 mm-10 mm).

6. The crib rail bumper of claim 1, wherein the cushioning pad and cover are compressible along the length dimension so as to encompass crib rails of between approximately 6-26 inches (~15-66 cm).

7. The crib rail bumper of claim 1, wherein the fabric cover comprises:

a first side formed of a first fabric; and a second side formed of a second fabric.

8. The crib rail bumper of claim 1, wherein the fabric cover further comprises a resealable opening to allow insertion and removal of the cushioning pad.

9. The crib rail bumper of claim 8, wherein the resealable opening comprises a hook and loop closure.

10. The crib rail bumper of claim 8, wherein the resealable opening comprises a zipper closure.

11. The crib rail bumper of claim 10, wherein the zipper closure is formed of plastic and comprises a slider without a pull.

12. The crib rail bumper of claim 1, wherein the cushioning pad is a closed-cell polyethylene foam.

13. The crib rail bumper of claim 12, wherein the closed-cell polyurethane foam has a thickness of ¼ inch (6.35 mm).

14. The crib rail bumper of claim 1, wherein the cushioning pad is an open-cell polyurethane foam.

15. The crib rail bumper of claim 14, wherein the open-cell polyurethane foam has a thickness of ⅜ inch (9.5 mm).

16. The crib rail bumper of claim 1, wherein the cushioning pad is formed of natural latex foam.

17. The crib rail bumper of claim 16, further comprising a lining of polypropylene non-woven material covering the natural latex foam cushioning pad.

18. The crib rail bumper of claim 2, wherein the opposite sides of the zipper are connectable to corresponding zipper portions of another crib rail bumper in accordance with claim 2 so as to encompass a wide crib rail or a plurality of adjacent crib rails.

19. A set of crib rail bumpers comprising a plurality of crib rail bumpers in accordance with claim 2, wherein each crib rail bumper is substantially identical in size.

20. The set of crib rail bumpers of claim 19, wherein the major length dimension of each cushioned pad is approximately 24 inches (~61 cm) and the minor width dimension of each cushioned pad is approximately 6 inches (~15 cm).

21. The set of crib rail bumpers of claim 19, wherein each cushioning pad and cover are compressible along the length dimension so as to encompass crib rails of between approximately 6-26 inches (~15-66 cm).

22. The set of crib rail bumpers of claim 19, wherein each fabric cover comprises:

a first side formed of a first fabric; and a second side formed of a second fabric.

* * * * *